US012510326B1

(12) United States Patent
Maschin et al.

(10) Patent No.: US 12,510,326 B1
(45) Date of Patent: Dec. 30, 2025

(54) TOY LAUNCHER ADJUSTABLE INLINE BARREL PROJECTILES ALIGNMENT METHODS AND APPARATUS

(71) Applicant: Hasbro, Inc., Pawtucket, RI (US)

(72) Inventors: Robert C Maschin, Johnston, RI (US); David Drew Weiand, Johnston, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 18/678,939

(22) Filed: May 30, 2024

Related U.S. Application Data

(60) Provisional application No. 63/539,482, filed on Sep. 20, 2023.

(51) Int. Cl.
*F41B 11/73* (2013.01)
*F41B 11/52* (2013.01)
*F41B 11/641* (2013.01)

(52) U.S. Cl.
CPC ..... *F41B 11/73* (2013.01); *F41B 11/52* (2013.01); *F41B 11/641* (2013.01)

(58) Field of Classification Search
CPC ..... F41B 11/641; F41B 11/52; F41B 11/73
USPC ..... 124/60, 61, 63, 72, 71
See application file for complete search history.

(56) References Cited

U.S. PATENT DOCUMENTS

| | | | |
|---|---|---|---|
| 46,617 | A | 3/1865 | Allen |
| 159,609 | A | 2/1875 | Prescott |
| 956,760 | A | 5/1910 | Moulin |
| 1,441,975 | A | 1/1923 | Edelin |
| 1,488,995 | A | 4/1924 | McCollom |
| 1,743,576 | A | 1/1930 | Smith |
| 1,873,677 | A | 8/1932 | Traver |
| 2,214,224 | A | 9/1940 | Douglas |
| 2,483,752 | A | 10/1949 | Buhl |
| 2,634,717 | A | 4/1953 | Junkin |
| 2,725,868 | A | 12/1955 | Foster |
| 2,737,942 | A | 3/1956 | Horowitz et al. |
| 3,054,536 | A | 9/1962 | Sagarin |
| 3,262,440 | A | 7/1966 | Kuhn |
| 3,385,279 | A | 5/1968 | Pitcher |
| 3,420,133 | A | 1/1969 | Proll |
| 3,584,614 | A | 6/1971 | Horvath |
| 3,847,132 | A | 11/1974 | Schatz |
| 3,990,426 | A | 11/1976 | Stokes |
| 4,094,294 | A | 6/1978 | Speer |
| 4,345,578 | A | 8/1982 | Speer |
| 4,597,527 | A | 7/1986 | Sands |
| 4,774,929 | A | 10/1988 | Millman |
| 4,841,945 | A | 6/1989 | Braden |
| 4,890,404 | A | 1/1990 | Ferri |

(Continued)

*Primary Examiner* — John Cooper
(74) *Attorney, Agent, or Firm* — Perry Hoffman

(57) ABSTRACT

Launcher apparatus and methods for a toy projectile blaster with an adjustable inline barrel projectile loading functionality with a multi-shot projectile alignment extension mechanism switching selector allowing for barrel to slide including a barrel seal to align received projectiles for launching through a blaster barrel, and a channel into the alignment mechanism for a compressed air source. A pre-firing area and actuator at the housing are linked with the compressed air source for causing compressed air to expel through the channel into the alignment mechanism and outwardly launch the received projectile rounds.

20 Claims, 14 Drawing Sheets

(56) References Cited

U.S. PATENT DOCUMENTS

| | | | |
|---|---|---|---|
| 5,205,271 | A | 4/1993 | Salva |
| 5,244,153 | A | 9/1993 | Kuhn et al. |
| 5,267,549 | A | 12/1993 | Webber |
| 5,343,850 | A | 9/1994 | Steer |
| 5,471,967 | A | 12/1995 | Matsuzaki et al. |
| 5,529,050 | A | 6/1996 | D'Andrade |
| 5,535,729 | A | 7/1996 | Griffin et al. |
| 5,704,150 | A | 1/1998 | Millman |
| 5,878,734 | A | 3/1999 | Johnson et al. |
| 6,119,671 | A | 9/2000 | Smith et al. |
| 6,460,530 | B1 | 10/2002 | Backeris et al. |
| 6,488,019 | B2 | 12/2002 | Kotsiopoulos |
| 7,051,727 | B2 | 5/2006 | Wu |
| 8,082,909 | B2 | 12/2011 | Sopinsky et al. |
| 8,113,188 | B2 | 2/2012 | Ma |
| 8,127,753 | B1 | 3/2012 | Brooks et al. |
| 8,127,754 | B1 | 3/2012 | Johnson et al. |
| 8,336,531 | B2 | 12/2012 | Fan et al. |
| 8,371,282 | B2 | 2/2013 | Meggs et al. |
| 8,397,705 | B2 | 3/2013 | DeHaan et al. |
| 8,567,378 | B2 | 10/2013 | Nugent |
| 8,640,683 | B2 | 2/2014 | Meggs et al. |
| 8,695,579 | B2 | 4/2014 | Huebl |
| 8,875,688 | B2 | 11/2014 | Nugent |
| 9,097,476 | B2 | 8/2015 | Mead et al. |
| 9,097,477 | B1 | 8/2015 | Mead et al. |
| 9,389,042 | B1 | 7/2016 | Clayton |
| 9,500,436 | B2 | 11/2016 | Macy |
| 9,958,230 | B1 | 5/2018 | Nugent et al. |
| 10,488,143 | B2 | 11/2019 | Victor et al. |
| 10,488,148 | B2 | 11/2019 | Johnson et al. |
| 10,823,527 | B2 | 11/2020 | Tino et al. |
| 10,876,809 | B1 | 12/2020 | Kopman et al. |
| 10,907,929 | B2 | 2/2021 | Bernal |
| 2002/0166551 | A1 | 11/2002 | Lee |
| 2007/0034197 | A1 | 2/2007 | Tschech |
| 2009/0095272 | A1 | 4/2009 | Zimmerman |
| 2009/0145412 | A1 | 6/2009 | Barish |
| 2010/0206281 | A1 | 8/2010 | Kanitz et al. |
| 2012/0132187 | A1* | 5/2012 | Murray ..... F41B 11/721 124/45 |
| 2013/0112184 | A1 | 5/2013 | Corsiglia et al. |
| 2013/0146043 | A1 | 6/2013 | Zarecky et al. |
| 2013/0312722 | A1 | 11/2013 | Price |
| 2014/0230802 | A1* | 8/2014 | Cort ..... F41B 11/70 124/84 |
| 2016/0018184 | A1 | 1/2016 | Park |
| 2024/0328748 | A1* | 10/2024 | Sweeting ..... F41B 11/73 |

* cited by examiner

TOY LAUNCHER ADJUSTABLE INLINE BARREL PROJECTILES ALIGNMENT METHODS AND APPARATUS

FIELD OF THE INVENTION

The present invention relates generally to launcher apparatus and methods for a toy projectile blaster discharging projectiles such as foam rounds, balls, and flexible projectiles including hydrated super absorbent polymer (SAP) beads, and more particularly, for discharging with adjustable inline barrel projectile loading functionality with a multi-shot projectile alignment extension mechanism switching selector allowing for barrel to slide projectile rounds in a novel fashion providing for toy blaster for continuous feeding of projectiles within a breech and/or breechless projectile with launch alignment mechanisms.

BACKGROUND OF THE INVENTION

Toys are often designed to have play value by simulating a real object, safely and at a reasonable expense. Toy launch apparatus have been marketed as toys for decades and include such devices as water pistols, toy BB rifles, foam projectiles, balls discs, dart blasters and NERF® brand launchers that discharge a soft foam dart. Most air launchers discharging projectiles use a launch spring and a piston and cylinder arrangement to generate the energy and direct that energy to cause the projectile to discharge. The launching apparatus themselves come in various forms, including those simulating rifles, guns, machine guns, shotguns, bows, rocket launchers, grenade launchers and foam car launchers. Generally, from design and function standpoints control of the size and operation of an air chamber in the cylinder is desirable for efficiency and cost considerations.

Projectile launch mechanisms are known in the art and include mechanisms for launching toy darts, balls of various sizes, paint balls, etc. Known projectiles also include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™, stylized toy rifles that launches gel balls or 'gelfire' rounds. In the alternative made of NERF™ brand foam, a solid, spongy cellular material.

The inventions discussed in connection with the described embodiments address these and other deficiencies of the prior art. The features and advantages of the present inventions will be explained in or become apparent from the following summary and description of the preferred embodiments considered together with the accompanying drawings. The projectiles for such launching apparatus include soft foam darts of various designs and sizes, foam balls, also of various sizes, and other soft projectiles.

SUMMARY OF THE INVENTIONS

In accordance with the present invention, an advantageous method and apparatus are provided in the form of a launch apparatus designed to discharge soft projectiles, with an advantageous method and system are described in the form of an improved barrel seal is aligned with a passage at the alignment mechanism. A pre-firing area is defined inside the alignment mechanism extending between the receptacle and the at least one barrel seal. A channel into the alignment mechanism capable of fluid communication with the compressed air source. The pre-firing area is enabled to align at least one of the received projectiles at the at least one barrel seal.

Briefly summarized, the inventions relate to a toy launching apparatus capable of launching projectile rounds fed through an adjustable inline barrel projectile loading functionality with a multi-shot projectile alignment extension mechanism switching selector allowing for barrel to slide. The projectile launcher includes the barrel seal to align received projectiles for launching through a blaster barrel with the compressed air source for causing compressed air to expel through the channel into the alignment mechanism and outwardly launch the received projectile rounds. An actuator at the housing and linked with the compressed air source for causing compressed air to expel through the channel into the alignment mechanism and outwardly launch the one or more received projectile rounds through the at least one barrel seal of the launching barrel.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

The switching selector allows for the adjustment of the barrel seal 25. In the further embodiments, the adjustment of the barrel seal 25 is provided by translating the barrel 14. The adjustment of the barrel seal 25 may be provided by other mechanisms. Adjusting the barrel seal 25 allows for adjusting the number of projectiles 22 positioned at the barrel seal 25. Hence, the switch selector may adjust the number of projectiles 22 fired at once.

Figure 1A:
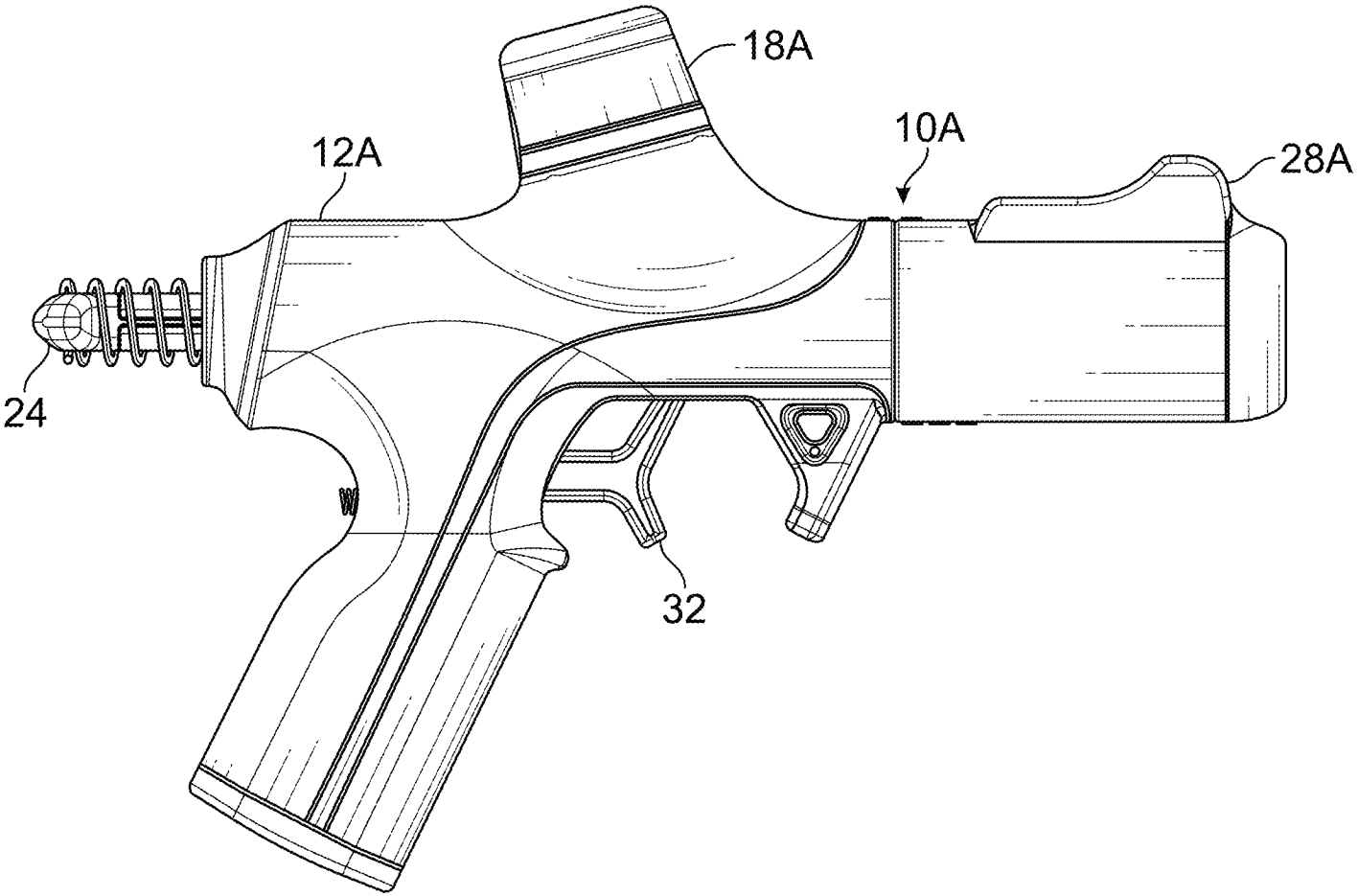
FIGS. 1A and 1B are elevational and cross-sectional views of a first embodiment of the present invention in the form of a toy projectile blaster.
Figure 1B:
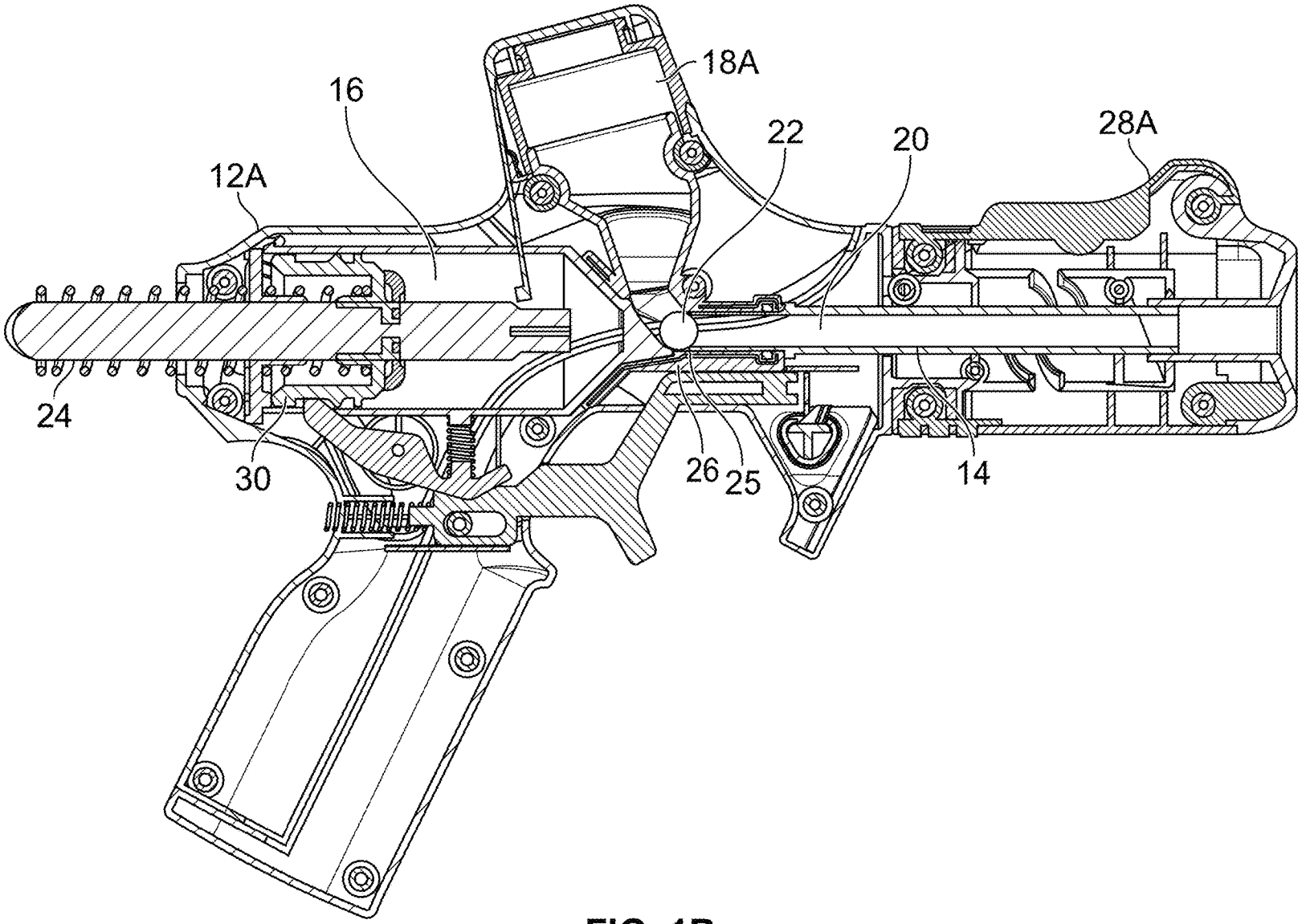

FIG. 1A shows the first embodiment toy projectile blaster launching apparatus 10A. Referring to FIGS. 1A, 1B, 1C, and 1D, the toy launching apparatus 10A is illustrated with a housing 12A with a projectile alignment mechanism 20 or firing mechanism for launching one or more of multiple received projectile rounds 22 or balls. The alignment mechanism 20 includes a receptacle 18A has the projectile rounds received into the alignment mechanism, with the receptacle located along an upper portion of the alignment mechanism. FIGS. 1A and 1B are elevational and cross-sectional views of the first embodiment toy projectile blaster 10A using a multi-shot projectile alignment mechanism twist selector switching 28A, where the FIG. 1D exploded view of a toy projectile blaster 10A has half of the housing removed to reveal internal mechanisms thereof for a multi-shot projectile alignment mechanism selector switching. Herein rotating the barrel 14 at twist selector switching 28A with rotational guide tracking 36A allows selection of one or three rounds 22 to obtain shooting of additional rounds with additional space as a breech projectile alignment multi-shot extension mechanism switching. Other combinations of options for additional rounds may be provided, including more than three additional rounds.

Figure 1C:
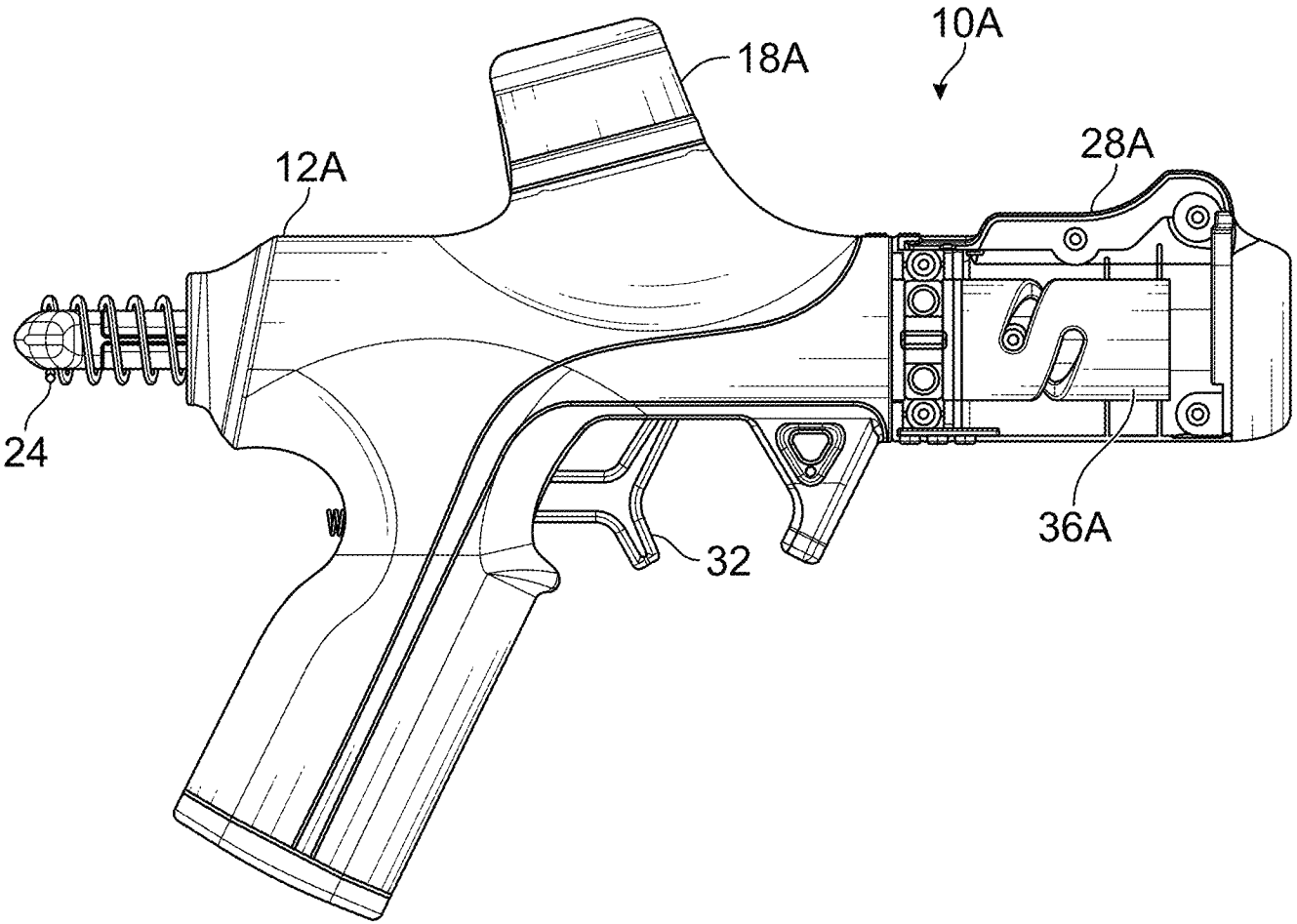
FIGS. 1C and 1D are diagrammatic side elevation and isometric exploded views of a toy projectile blaster illustrated in FIGS. 1A and 1B, showing an embodiment of a multi-shot projectile alignment mechanism twist selector switching having half of the housing removed to reveal internal mechanisms in accordance with the present inventions.
Figure 1D:
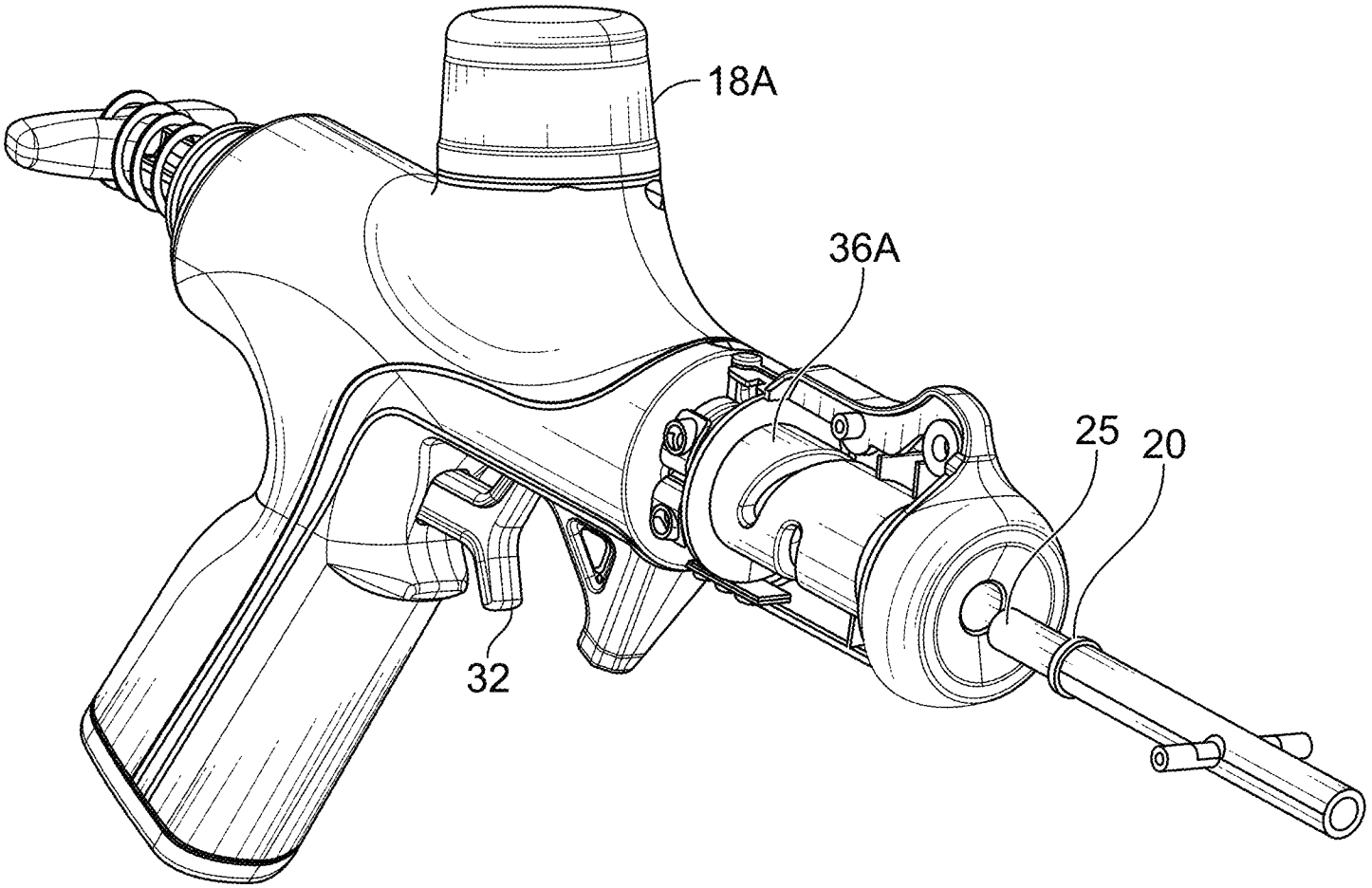

The alignment mechanism embodiments in assembly and section views include the air channel, projectiles hopper, and barrel seal sections, showing initial operation staging of sequenced projectile rounds discussed below. FIGS. 1C and 1D provide diagrammatic exposed side and isometric expanded views of the projectile blaster launching apparatus 10A illustrated in FIG. 1A with the toy apparatus having half of the housing 12A and 28A removed to reveal internal mechanisms, with FIG. 1D showing an exploded view thereof. The adjustable inline barrel projectile loading functionality with multi-shot projectile alignment extension mechanism switching selector allowing for barrel to slide (rotationally or translationally) location of barrel seal 25 for adjustment of number of rounds admitted into breech in advance of barrel 14; rotational or translational mechanism to elongate distance between seal and hopper outlet to admit more projectiles into breech for firing. Piston 30 mounted in the cylinder 16 is operable with a seated drive spring, with an extending elongated handle 24 to allow piston drive spring operation by a user. FIGS. 1C and 1D are diagrammatic side elevation and isometric exploded views of a toy projectile blaster illustrated in FIG. 1A, showing an embodiment of a multi-shot projectile alignment mechanism twist selector switching having half of the housing removed to reveal internal mechanisms. Herein rotating the barrel 14 at twist selector 28A with rotational guide tracking of 36A allows 180 degrees rotation to obtain additional distance for 2 additional rounds, for three (3) rounds 22, also allowing to rotate 90 degrees to admit a single rounds. Other options for the number of additional rounds may be provided. An option for more than three additional rounds may be provided.

Additionally, air dampening elements may be provided within the receptacle 18A to mitigate residual air pressure caused by firing. Residual air pressure may remain after firing and cause the next round to be improperly positioned. Air dampening elements may be provided as, but not limited to, a bleed hole, diaphragm, dead space. Any combination of air dampening elements may be provided. As the cross-sectional area of the bleed hole is much smaller than the cross-sectional area of the passage 26 most air pressure from firing will go through the passage. However, the residual air pressure will expel through the bleed hole. Diaphragms may be used in addition or as an alternative to dissipate the energy of the residual air pressure. Dead space may be used in addition or as an alternative to increase the volume of air. The increased volume of air decreases the average pressure.

Figure 2A:
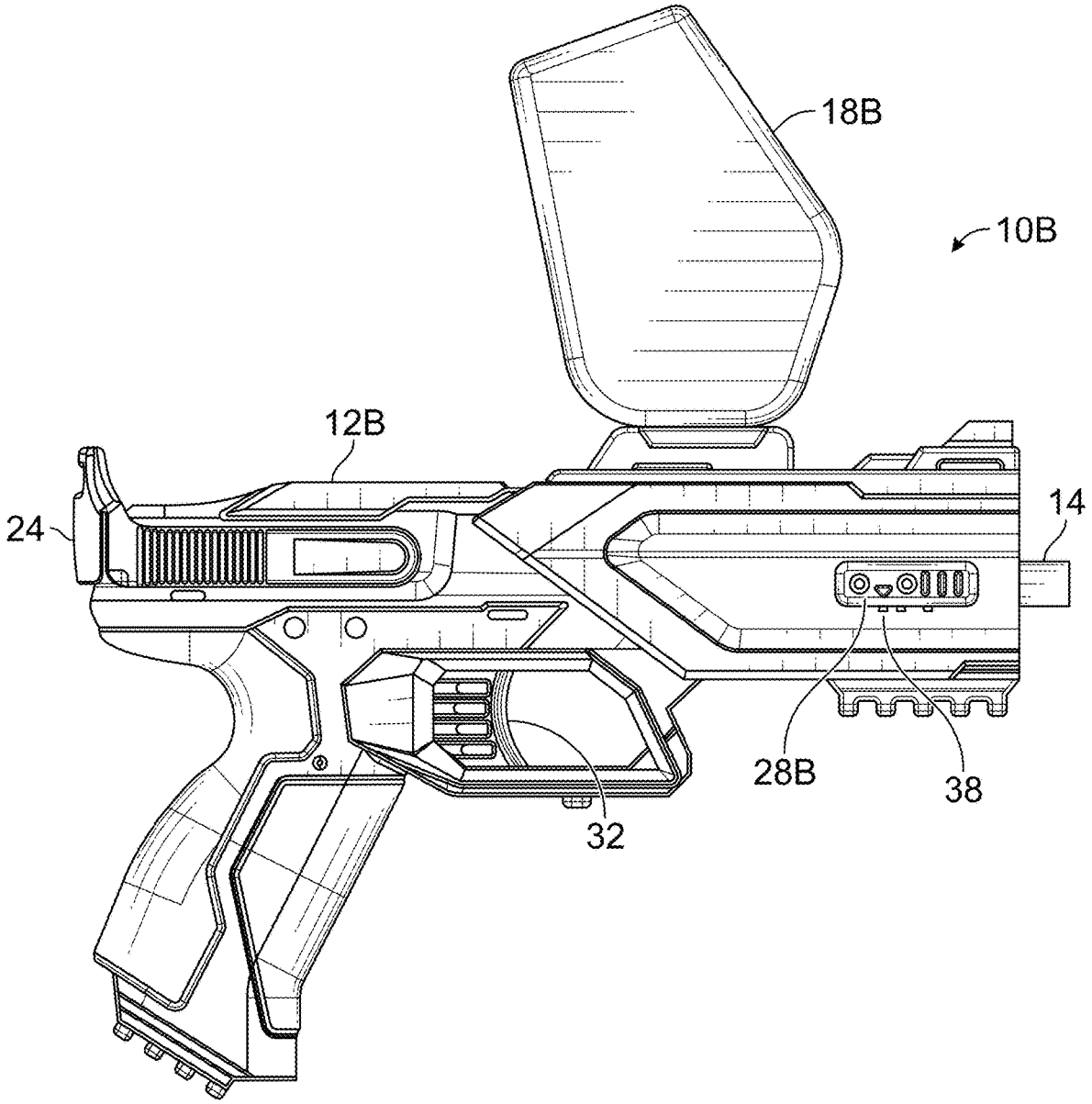
FIGS. 2A, 2B, 2C, and 2D illustrate a second alternate embodiment toy projectile blaster with a multi-shot projectile alignment mechanism slide selector switching having half of the housing removed to reveal internal mechanisms in accordance with the present inventions.
Figure 2B:
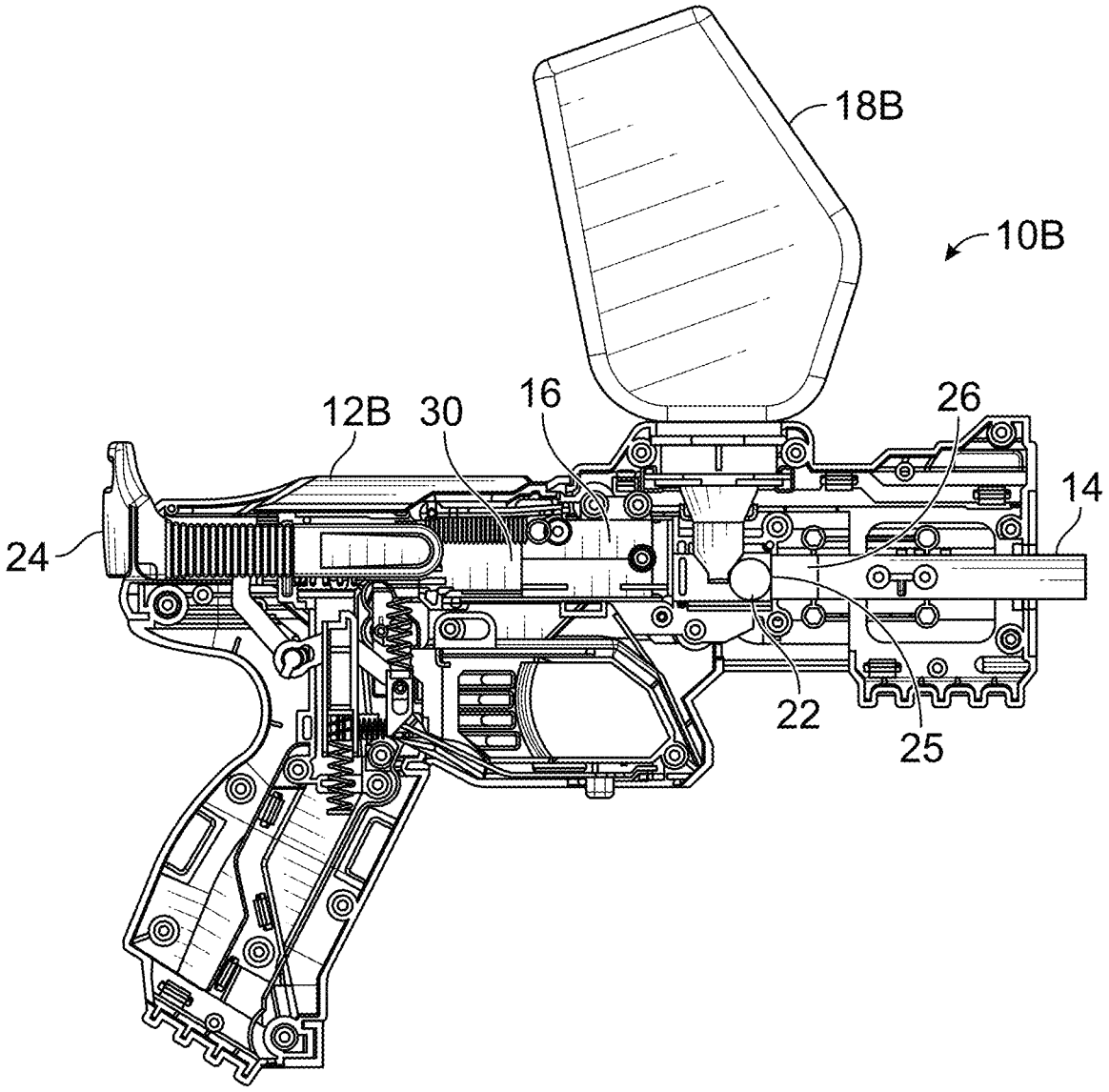
Figure 2C:
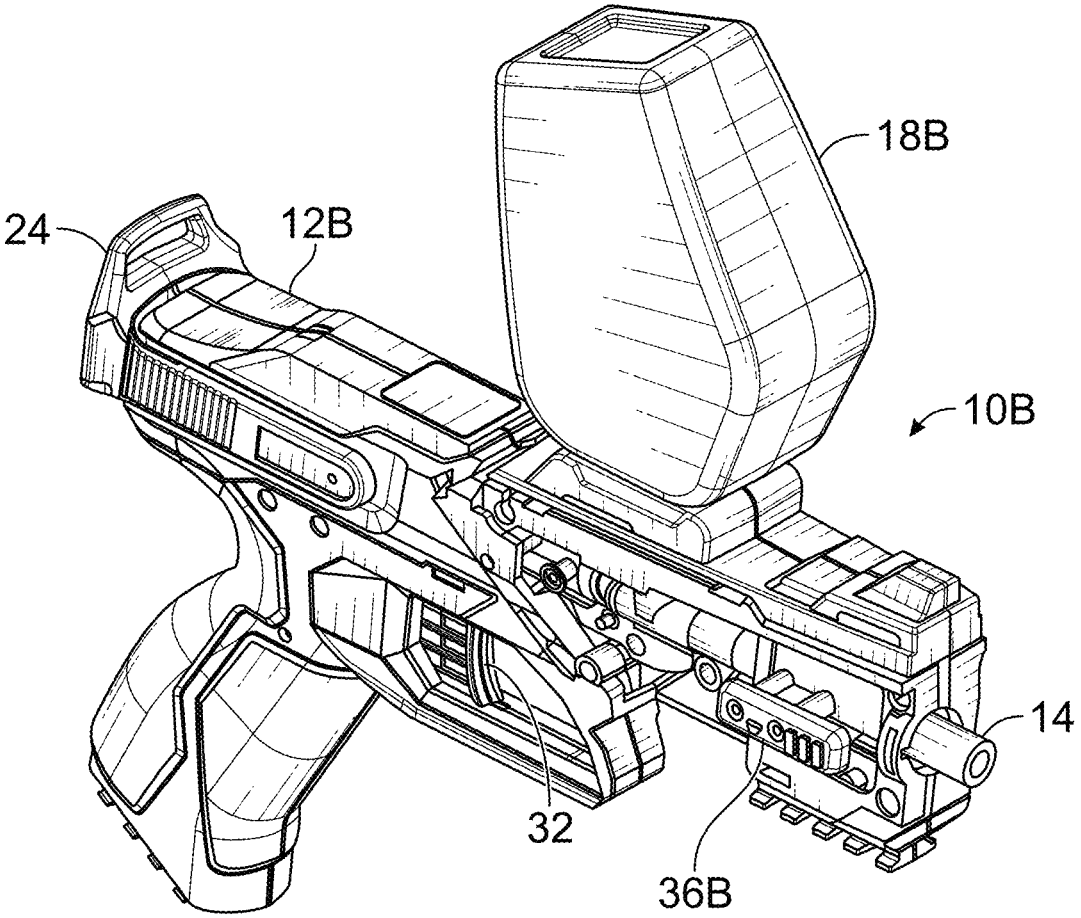
Figure 2D:
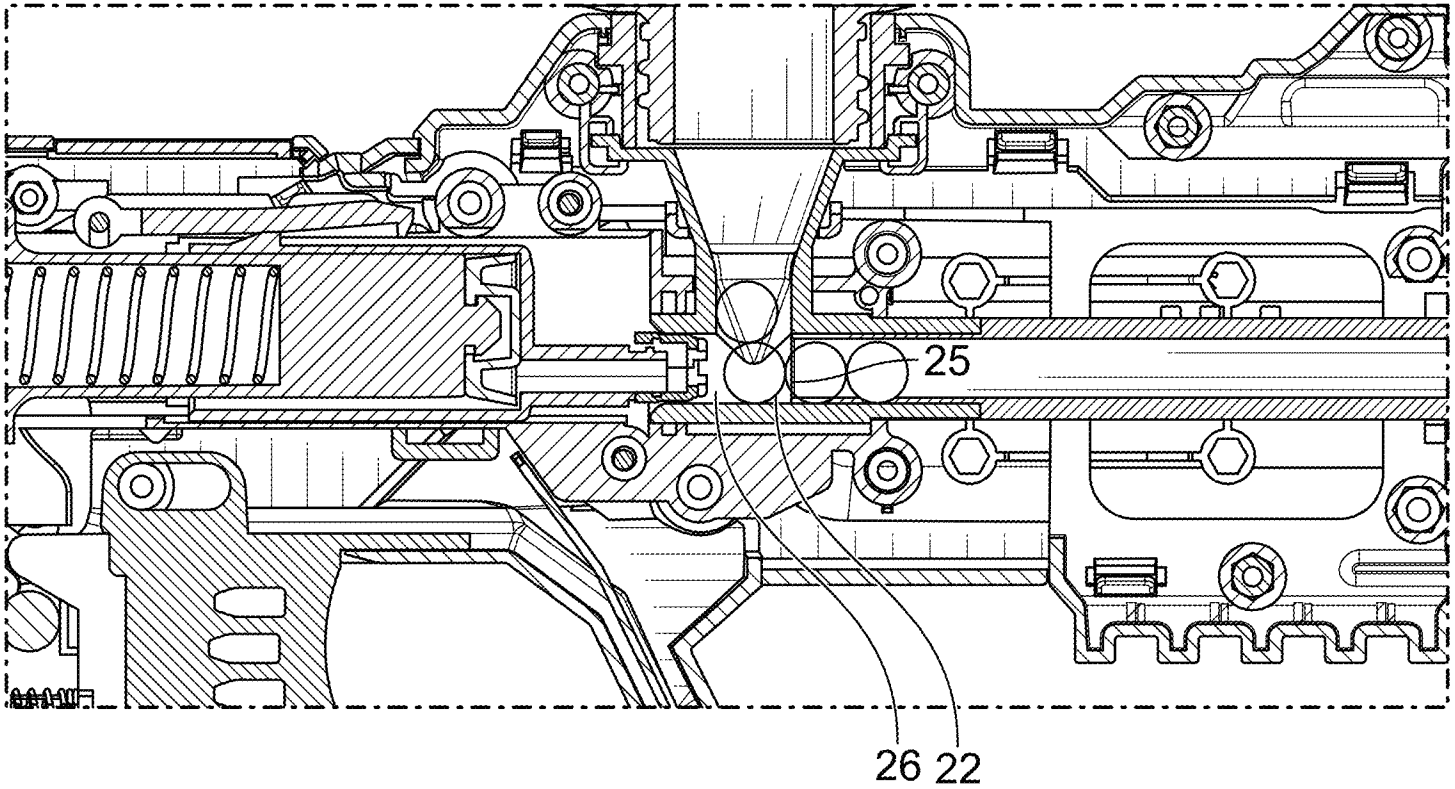

FIGS. 2A, 2B, 2C and 2D illustrate a second alternate embodiment toy projectile blaster of the projectile blaster launching apparatus 10B includes a hopper 18B illustrated in FIG. 2A with the toy apparatus having half of the housing 12B and 28B removed to reveal internal mechanisms shown in cross section in FIG. 2B. As shown in the FIGS. 2C and 2D views, the barrel seal 25 is aligned with a passage 26 within the alignment mechanism 20 capable of fluid communication with the compressed air source, with a multi-shot projectile alignment mechanism slide selector switching having half of the housing removed to reveal internal mechanisms in accordance with the second embodiment. Herein rotating the barrel 14 at slide selector 28B with translational guide tracking of 36B allows selection of 1-2-3 indicated at reference numeral 38, i.e., one, two, or three rounds 22 to obtain shooting of additional rounds with additional space as a breech projectile alignment multi-shot extension mechanism switching. Piston 30 mounted in the cylinder 16 is operable with a seated drive spring, with an extending elongated handle 24 to allow piston drive spring operation by a user.

The adjustable inline projectiles alignment may be employed with either a breechless blaster as shown in FIGS. 1A, 1B, 1C, 1D, 2A, 2B, or 2C but also as described for use with blasters or launchers having a breech and a breech bolt.

Figure 3A:
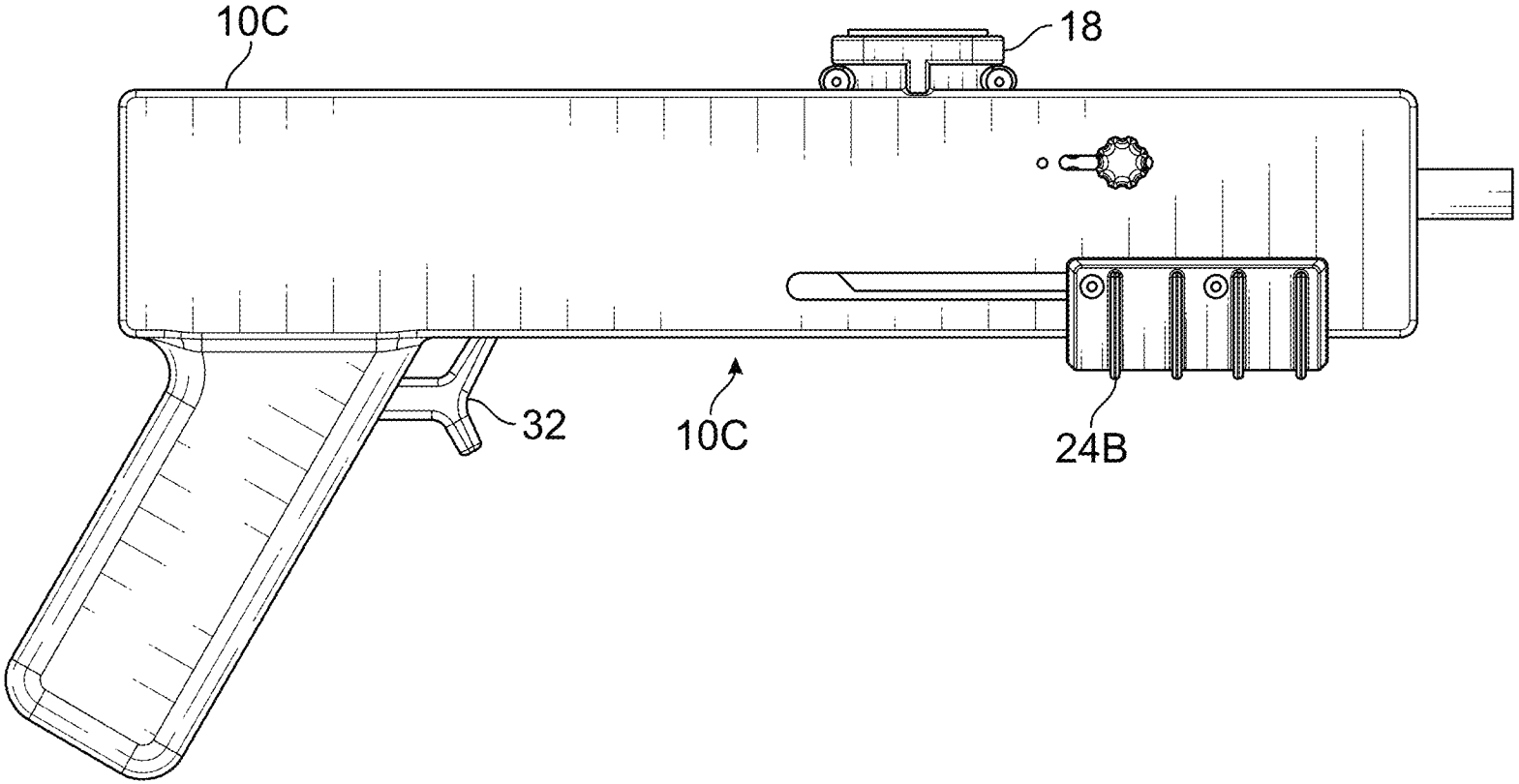
FIGS. 3A, 3B and 3C illustrate a third embodiment toy projectile blaster with a multi-shot projectile alignment mechanism slide selector switch having half of the housing removed to reveal internal mechanisms in accordance with the present inventions.
Figure 3B:
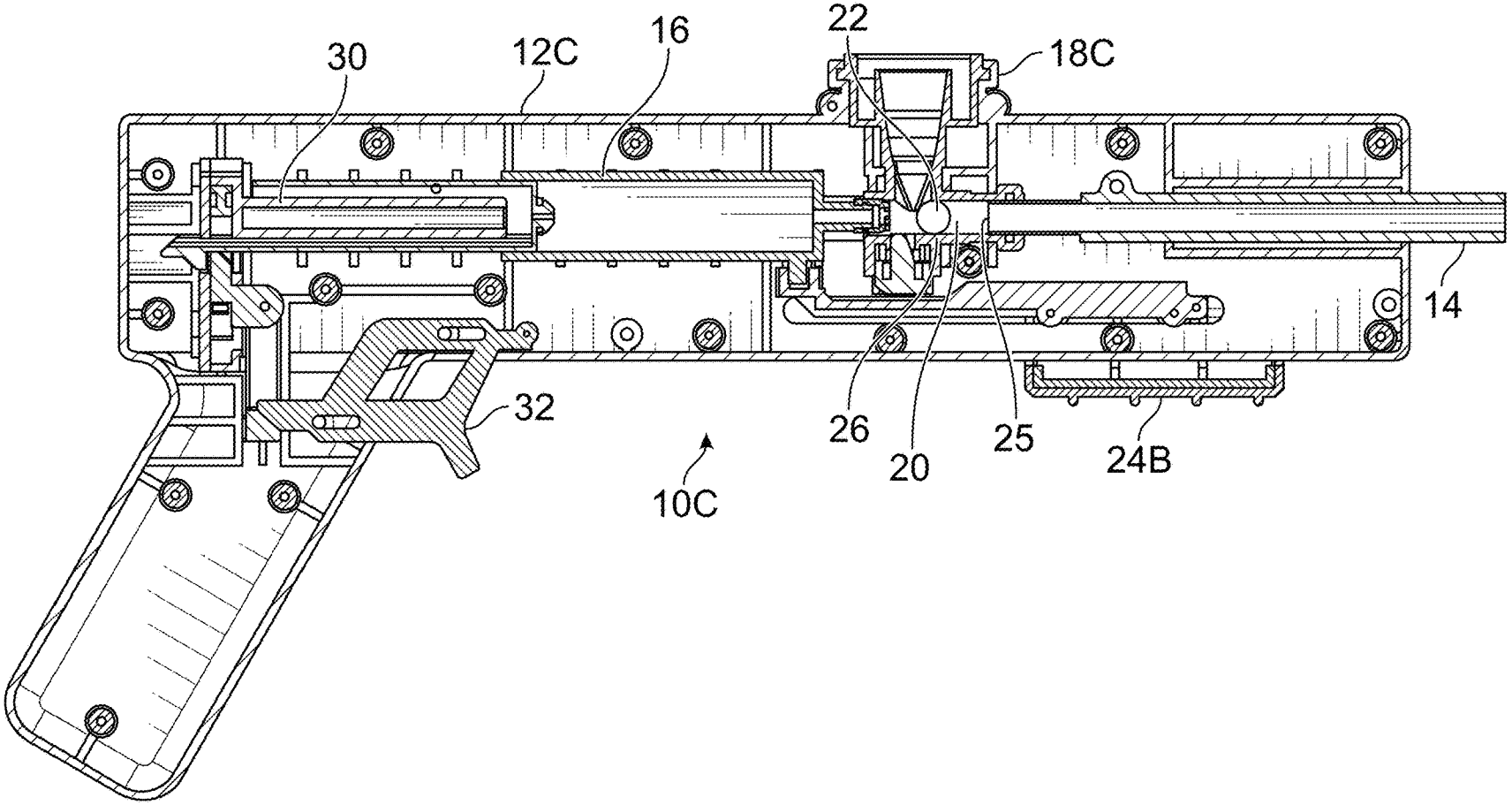
Figure 3C:
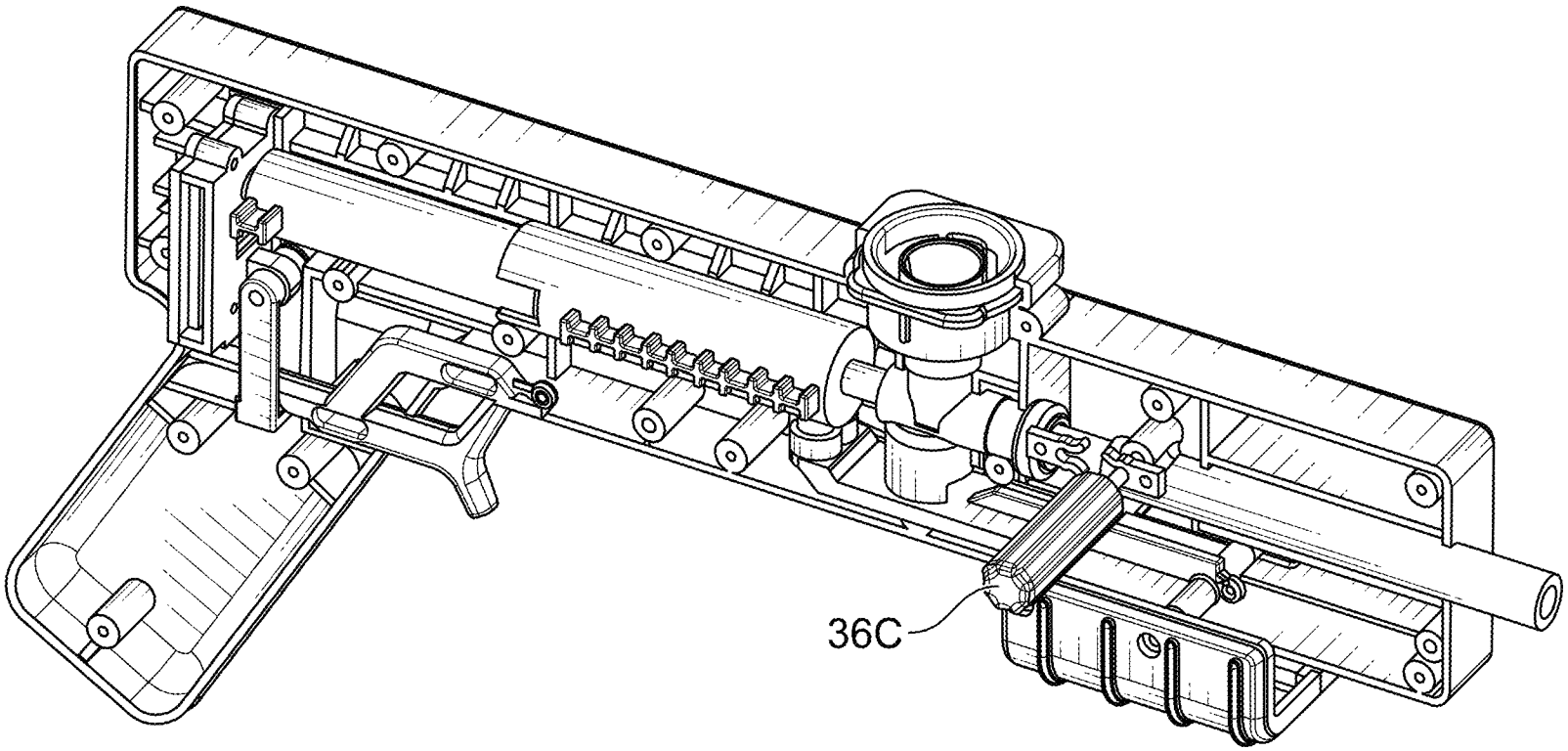

FIGS. 3A, 3B, and 3C provides a third alternative embodiment launching apparatus 10C includes a hopper 18C illustrated in FIG. 3A with the toy apparatus having half of the housing 12C revealing internal mechanisms shown in cross section in FIG. 3B. The barrel 14 or more broadly the launch site section, with a trigger 32 actuator at the housing 12C, and linked with grip section of the housing 12C forms a cylinder 16 where mounted in the cylinder 16 is a piston 30 operable with a seated drive spring, with an extending elongated handle to allow piston drive spring operation by a user.

As discussed further, a barrel seal 25 is aligned with a passage 26 within the alignment mechanism 20 capable of fluid communication with the compressed air source, e.g., the cylinder 16 and piston 30. Piston 30 mounted in the cylinder 16 is operable with a seated drive spring, with a priming handle 24B to allow piston drive spring operation by a user. In the regard, the alignment mechanism 20 is capable of launching projectile rounds 22, while selectively allowing singular, plural, or a multiplicity of the projectile rounds 22 to be received into a pre-firing area at the alignment mechanism 20. The received projectiles 22 align within the pre-firing area with reference to received projectiles 22 aligning at the at least one barrel seal 25. The trigger 32 linked the compressed air source causes compressed air to expel into the alignment mechanism 20 and outwardly to launch the one or more received projectile rounds 22 through the barrel seal 25 and the launching barrel 14. As shown in FIG. 3C the adjustment handle 36C is used to adjust the position of barrel 14 and hence the barrel seal 25. Either one or three rounds may be positioned at the barrel seal 25 depending on the position of the barrel seal 25. More options for the number of additional rounds may be provided, including more than three.

In certain embodiments moving the round seal point closer to the air entry point, and/or removing dead air space in the alternative reduces take up air to be pressurized, adjusting the point of where the rounds sits and the point at which the air is redirected behind the round.

Before firing:

The round to be fired is just behind the barrel in a "pre-firing area".

The round falls into place

When firing:

The air (represented by flow lines) fills the hopper but cannot escape, so it takes the path of least resistance and pushes the round out the barrel. The pressure squeezes the round slightly in the barrel. The barrel is tight enough the round would not fallout on its own.

After firing:

Additional projectile rounds 22 are brought into into the pre-firing area at the back of the barrel.

Figure 4A:
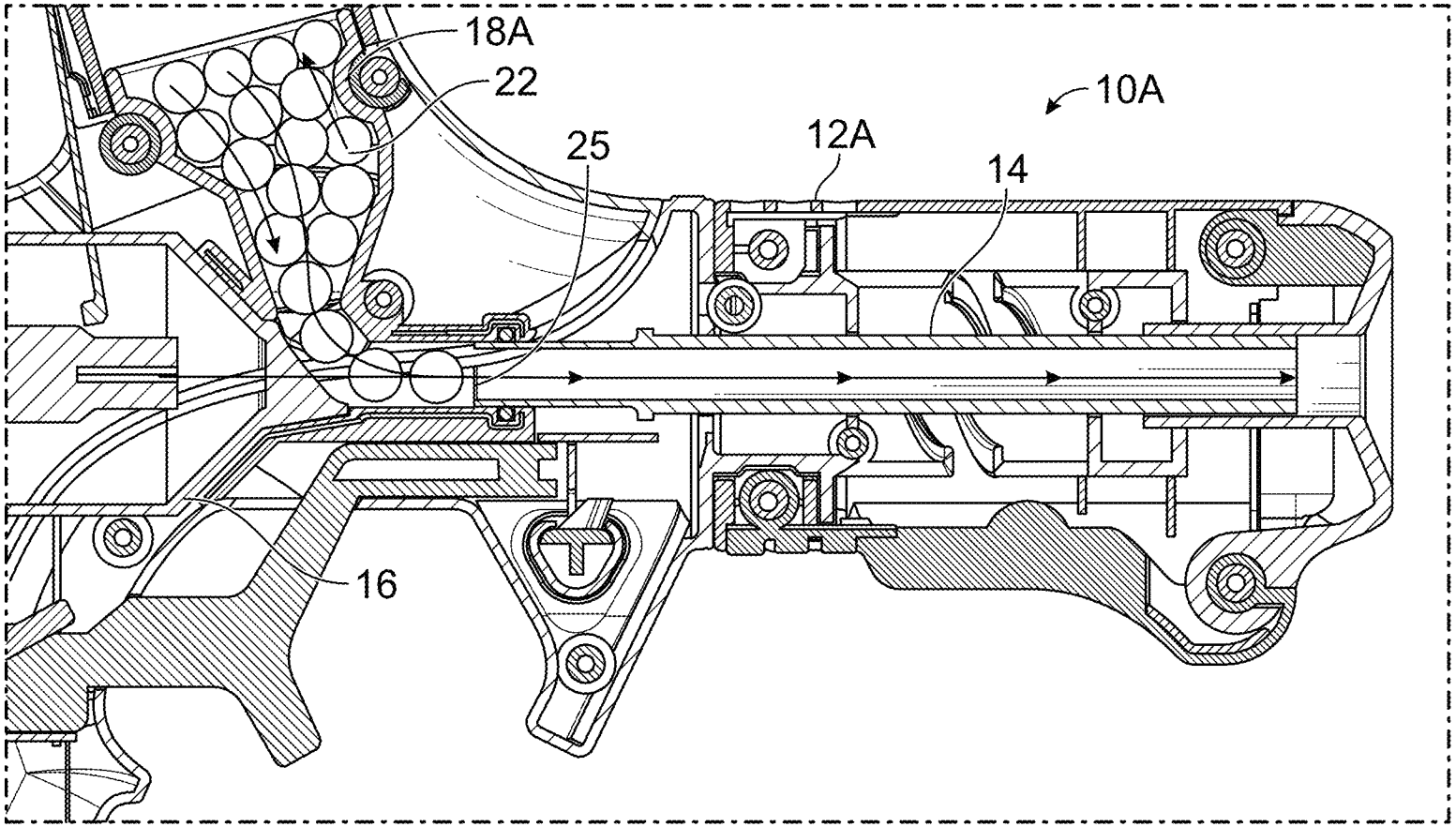
FIGS. 4A, 4B, and 4C illustrate the first embodiment launching apparatus assembly operations with respectively sequenced views in cross-section for staging of sequenced firing plural or multiple rounds sequentially in a single launch operation.
Figure 4B:
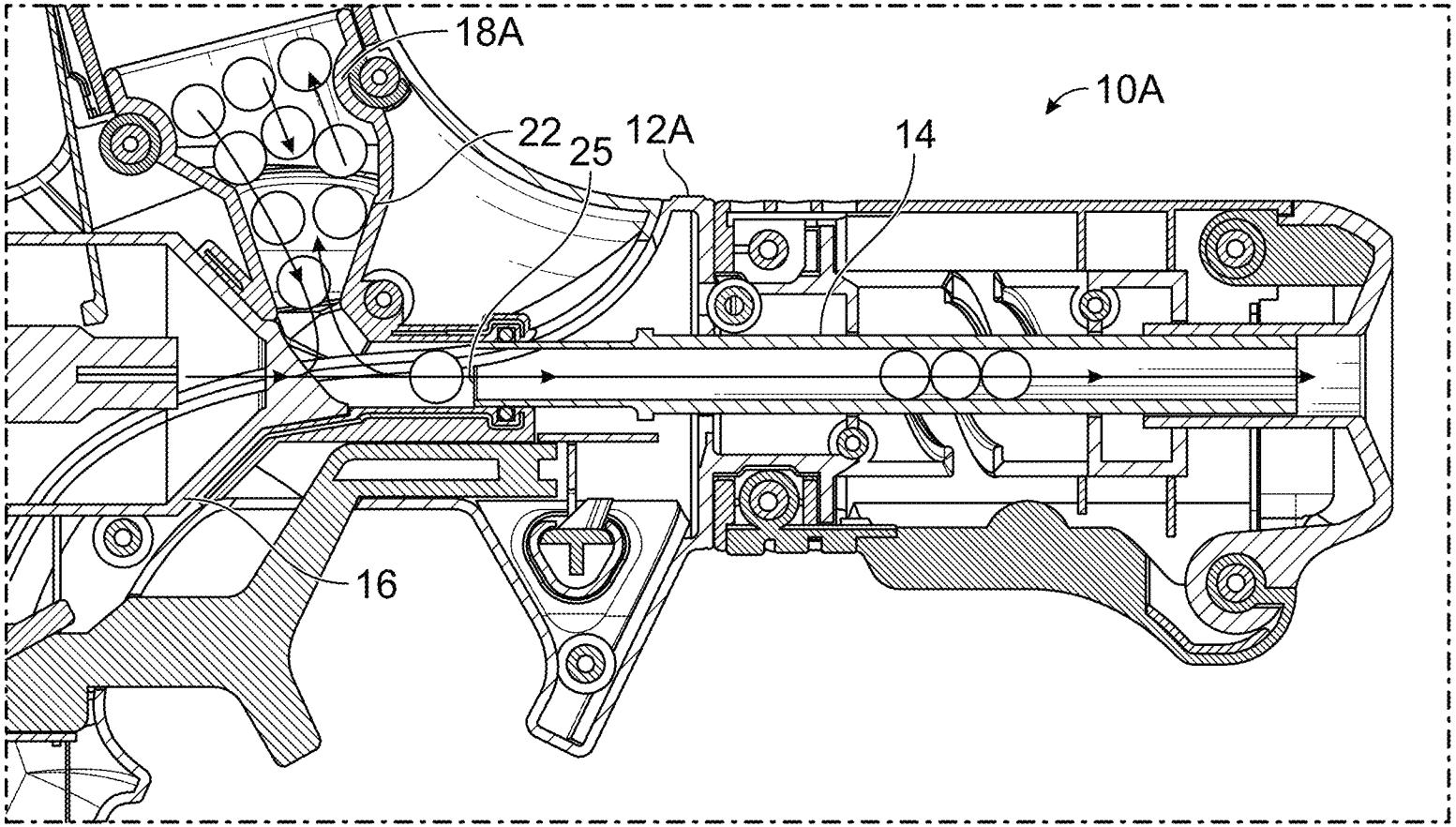
Figure 4C:
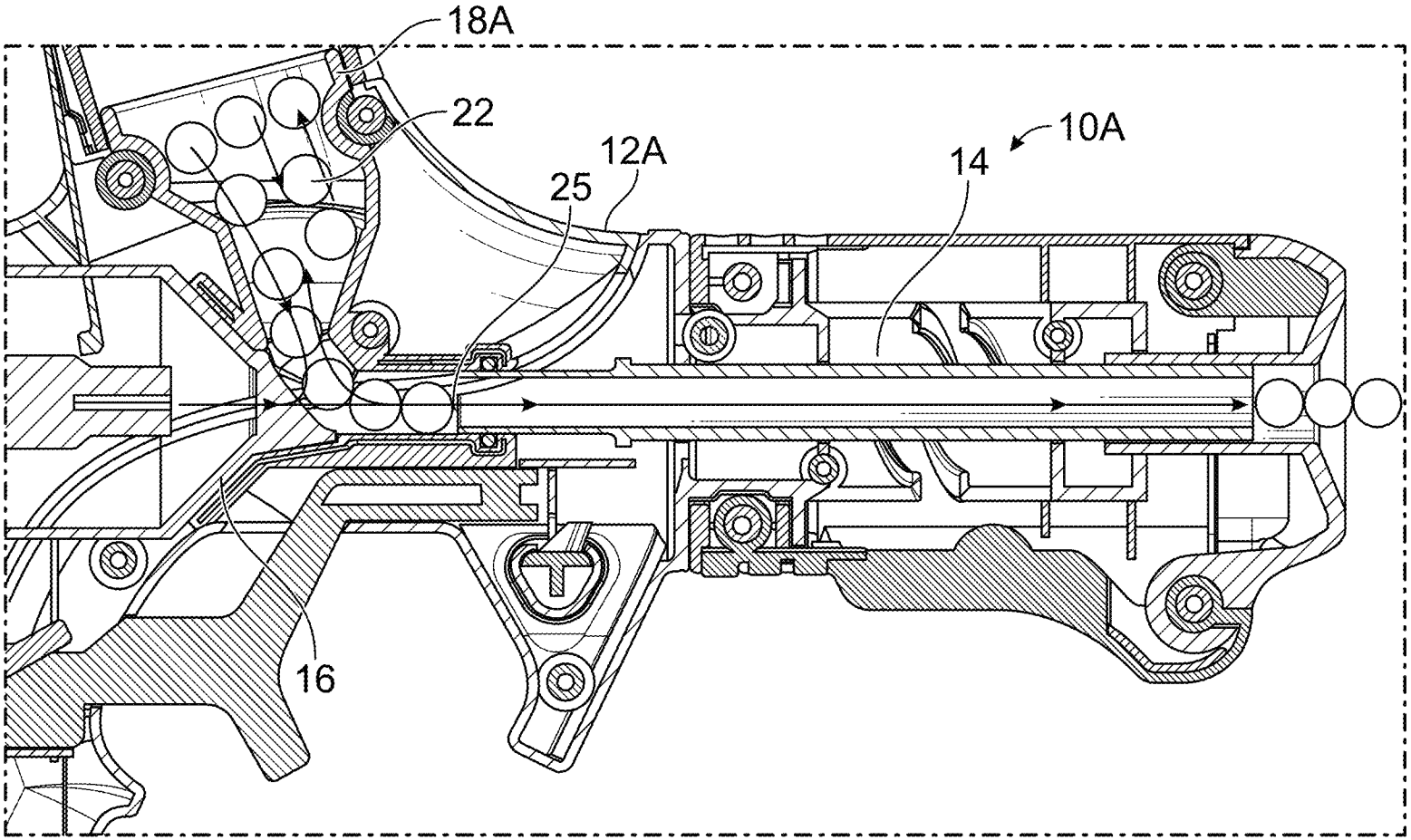

Blaster at rest, note rounds filling the bottom of the hopper because of gravity FIGS. 4A, 4B, and 4C illustrate launching apparatus assembly operations in cross-section staging of sequenced firing of three rounds sequentially in a single launch operation, with barrel seal 25 is aligned to extend into the barrel 14 to accommodate a plurality of rounds or multiple projectile rounds 22 for discharge with several received projectiles 22 aligning within the pre-firing area to at the at least one barrel seal 25. A motorized system version a motor driven compressed air sources, and/or a motorized actuator sub-system may also be employed.

FIG. 4A shows the blaster 10A prior to firing. Three projectiles 22 are positioned at barrel seal 25. Projectile rounds are shown in the receptacle 18A. FIG. 4B shows the blaster 10A during firing. A compressed air source propels the projectiles 22 position at the barrel seal 25 into the barrel 14. Additionally, air pressure enters the receptacle 18A. Air dampening elements may, such as but not limited to bleed holes, diaphragms or dead spaces may be provided. Additionally, any combination of air dampening elements maybe provided. FIG. 4C shows the blaster 10A after firing. The projectiles 22 have left the barrel 14. Projectiles 22 from the receptacle 18A enter the passage 26 and position themselves at the barrel seal 25. The barrel may be adjusted so that a different number of projectiles 22 may be positioned at the barrel 14.

The present invention also discloses improved projectile alignment mechanism methods in toy blaster launch apparatus including methods of the making the toy blaster apparatus. The methods include aligning one or more projectile rounds along a passage at the alignment mechanism including at least one barrel seal aligned with a projectile rounds launching barrel; a pre-firing area enabled to align at least one of the received projectiles at the at least one barrel seal; and actuating the channel for causing the compressed air to expel through the channel into the alignment mechanism and outwardly launch the one or more received projectile rounds through the at least one barrel seal and the launching barrel. The receiving of multiple projectile rounds through a receptacle may be further facilitated, allowing compressed air to expel through the channel to the alignment mechanism to multiple projectile rounds for launching outwardly through the at least one barrel seal.

From the foregoing, it can be seen that there has been provided features for an improved projectile alignment mechanism toy blaster launch methods and toy air blaster apparatus with a disclosure for the method of the making the toy blaster apparatus. While particular embodiments of the improved safety valve have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. An alignment mechanism for launching projectile rounds, comprising:

a receptacle allowing one or more projectile rounds to be received into the alignment mechanism, with the receptacle located along an upper portion of the alignment mechanism wherein the alignment mechanism with the receptacle can hold multiple projectile rounds;

at least one barrel seal aligned with a barrel passage at the alignment mechanism;

a channel for a compressed air source; and a switch selectable adjustable pre-firing area inline extension mechanism allowing the barrel passage to translate while maintaining fluid communication with the channel for the compressed air source extending to the at least one barrel seal thereof, the pre-firing area enabled to align one or more of the received projectiles at the at least one barrel seal.

2. The alignment mechanism of claim 1, wherein the at least one of the received projectiles align by gravity within the pre-firing area to at the at least one barrel seal.

3. The alignment mechanism of claim 1, comprising a projectile rounds launching barrel aligned with the at least one barrel seal form a seal with one or more of the projectile rounds for launching from the pre-firing area outwardly through the launching barrel.

4. The alignment mechanism of claim 3, comprising an actuator linked with the compressed air source for causing compressed air to expel through the channel into the alignment mechanism and outwardly launch the one or more received projectile rounds through the at least one barrel seal and the launching barrel.

5. The alignment mechanism of claim 4, wherein the switch selectable adjustable pre-firing area inline extension mechanism comprises a multi-shot projectile alignment mechanism selector allowing the barrel passage to translate for sealing the one or more projectile rounds with the alignment mechanism.

6. The alignment mechanism of claim 5, wherein the compressed air source is responsive to the actuator linked for causing compressed air to expel through the channel into the alignment mechanism, and outwardly through the launching barrel.

7. The alignment mechanism of claim 1, wherein the switch selectable adjustable pre-firing area inline extension mechanism comprises a multi-shot projectile alignment mechanism slide selector allowing the barrel passage to translate for sealing the one or more projectile rounds with the alignment mechanism.

8. The alignment mechanism of claim 1, wherein the one or more projectile rounds comprise hydrated super absorbent polymer beads.

9. The alignment mechanism of claim 1, wherein the switch selectable adjustable pre-firing area inline extension mechanism comprises a multi-shot projectile alignment mechanism twist selector allowing the barrel passage to translate for sealing the one or more projectile rounds with the alignment mechanism.

10. A toy launching apparatus, comprising:

a housing;

an alignment mechanism in the housing capable of launching projectile rounds received through a receptacle allowing a multiplicity of the projectile rounds to be received;

a projectile rounds launching barrel;

a passage at the alignment mechanism including at least one barrel seal aligned with the projectile rounds launching barrel;

a channel for a compressed air source;

at least one barrel seal aligned with a barrel passage at the alignment mechanism;

a switch selectable adjustable pre-firing area inline extension mechanism allowing the barrel passage to translate while maintaining fluid communication with the compressed air source extending to the at least one barrel seal thereof, the pre-firing area enabled to align one or more of the received projectiles at the at least one barrel seal; and an actuator at the housing and linked with the compressed air source for causing compressed air to expel through the channel into the alignment mechanism and outwardly launch one or more of the received projectile rounds through the at least one barrel seal and the launching barrel.

11. The toy launching apparatus of claim 10, wherein the switch selectable adjustable pre-firing area inline extension mechanism comprises a multi-shot projectile alignment mechanism twist selector allowing the barrel passage to translate for sealing the one or more projectile rounds with the alignment mechanism.

12. The toy launching apparatus of claim 11, wherein the compressed air source is responsive to the actuator linked for causing compressed air to expel through the channel into the alignment mechanism, and outwardly through the launching barrel.

13. The toy launching apparatus of claim 10, wherein the switch selectable adjustable pre-firing area inline extension mechanism comprises a multi-shot projectile alignment mechanism slide selector allowing the barrel passage to translate for sealing the one or more projectile rounds with the alignment mechanism.

14. The toy launching apparatus of claim 13, wherein the compressed air source is responsive to the actuator linked for causing compressed air to expel through the channel into the alignment mechanism, and outwardly through the launching barrel.

15. The toy launching apparatus of claim 10, wherein the one or more projectile rounds comprise hydrated super absorbent polymer beads.

16. A toy launching method, comprising:

receiving multiple projectile rounds through a receptacle to an alignment mechanism;

aligning one or more projectile rounds along a passage at the alignment mechanism including at least one barrel seal aligned with a projectile rounds launching barrel;

coupling a switch selectable adjustable pre-firing area inline extension mechanism allowing the barrel passage to translate while maintaining fluid communication with a channel for a compressed air source extending to the at least one barrel seal thereof;

defining a pre-firing area enabled to align one or more of the received projectiles at the at least one barrel seal; and actuating the channel for causing the compressed air to expel through the channel into the alignment mechanism and outwardly launch the one or more received projectile rounds through the at least one barrel seal and the launching barrel.

17. The toy launching method of claim 16, wherein the switch selectable adjustable pre-firing area inline extension mechanism comprises a multi-shot projectile alignment mechanism twist selector allowing the barrel passage to translate for sealing the one or more projectile rounds with the alignment mechanism.

18. The toy launching method of claim 16, wherein the switch selectable adjustable pre-firing area inline extension mechanism comprises a multi-shot projectile alignment mechanism slide selector allowing the barrel passage to translate for sealing the one or more projectile rounds with the alignment mechanism.

19. The toy launching method of claim 16, wherein the at least one of the received projectiles is aligned by gravity within the pre-firing area to at the at least one barrel seal.

20. The toy launching method of claim 16, wherein the receiving step comprises:

providing the receptacle as a hopper to the alignment mechanism wherein the one or more projectile rounds comprise hydrated super absorbent polymer beads projectile rounds received into the pre-firing area.

* * * * *